US011271345B2

(12) United States Patent
Wimmer

(10) Patent No.: US 11,271,345 B2
(45) Date of Patent: Mar. 8, 2022

(54) FLAT ANGULAR CONNECTOR WITH LATCH MECHANISM

(71) Applicant: ODU GmbH & Co. KG, Mühldorf (DE)

(72) Inventor: Franz Wimmer, Jettenbach (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/542,495

(22) Filed: Aug. 16, 2019

(65) Prior Publication Data

US 2020/0059038 A1 Feb. 20, 2020

(30) Foreign Application Priority Data

Aug. 20, 2018 (EP) ..... 18189737

(51) Int. Cl.

| | |
|---|---|
| ***H01R 13/627*** | (2006.01) |
| ***H01R 13/512*** | (2006.01) |
| ***H01R 12/62*** | (2011.01) |
| ***H01R 13/24*** | (2006.01) |
| ***H01R 13/52*** | (2006.01) |
| ***H01R 12/71*** | (2011.01) |
| *H01R 13/64* | (2006.01) |

(52) U.S. Cl.

CPC ..... *H01R 13/6272* (2013.01); *H01R 12/716* (2013.01); *H01R 13/512* (2013.01); *H01R 12/62* (2013.01); *H01R 13/2471* (2013.01); *H01R 13/5219* (2013.01); *H01R 13/64* (2013.01)

(58) Field of Classification Search

CPC ..... H01R 12/7076; H01R 13/2421; H01R 13/6275; H01R 13/6392; G06F 1/1632; H02G 15/007

USPC ..... 439/347

See application file for complete search history.

(56) References Cited

U.S. PATENT DOCUMENTS 4,341,428 A * 7/1982 Hatch ..... H01R 13/6456 439/157
4,787,858 A 11/1988 Killian, Jr.
4,915,650 A * 4/1990 Daly ..... H01R 11/11 439/422
5,435,744 A 7/1995 Derstine et al.
(Continued)

FOREIGN PATENT DOCUMENTS

CN 2922167 Y 7/2007
CN 101635413 A 1/2010
(Continued)

*Primary Examiner* — Jean F Duverne
(74) *Attorney, Agent, or Firm* — Harris Beach PLLC; Laura W. Smalley

(57) ABSTRACT

A flat connector with a latch mechanism having two latch handle portions provided at opposite sides of the connector where the latch handle portions can be moved from an engagement position to a release position. The connector is an angular cable connector and for both handle portions, the direction of the path from the engagement position to the release position is towards the cable end of the connector. The latch handle portions are elastically biased towards their engagement position. The path from the engagement position to the release position is linear. The path from the engagement position to the release position is towards the cable end of the connector and extends in the plane of the handle portion.

22 Claims, 10 Drawing Sheets

(56) References Cited

U.S. PATENT DOCUMENTS 5,470,238 A * 11/1995 Walden ..... H01R 12/775 439/98
5,941,726 A * 8/1999 Koegel ..... H01R 13/6275 439/354
6,293,813 B1 * 9/2001 Johnston ..... H01R 13/62905 439/157
6,398,564 B1 * 6/2002 Wong ..... H01R 13/639 439/131
6,454,608 B1 * 9/2002 Kitahara ..... H01R 13/2421 439/638
6,483,698 B1 * 11/2002 Loh ..... G06F 1/1632 320/113
7,318,740 B1 1/2008 Henry et al.
7,442,060 B2 10/2008 Suwalski et al.
D615,040 S 5/2010 Slippy et al.
8,241,053 B2 * 8/2012 Slippy ..... H02G 15/007 439/353
8,262,403 B2 * 9/2012 Slippy ..... H01R 13/6275 439/353
8,360,795 B2 * 1/2013 Moore ..... H01R 13/6392 439/342
8,579,641 B1 * 11/2013 Queru ..... H01R 33/7671 439/224
9,300,086 B1 3/2016 Qu et al.
D769,823 S 10/2016 Qu et al.
9,692,175 B2 * 6/2017 Grziwok ..... H01R 13/6271
2015/0229075 A1 8/2015 Lin et al.
2015/0288104 A1 * 10/2015 Regnier ..... H01R 12/7076 439/676
2018/0166797 A1 * 6/2018 Ju ..... H01R 4/023

FOREIGN PATENT DOCUMENTS

CN 201438526 U 4/2010
CN 102570183 A 7/2012
CN 102598428 A 7/2012
CN 103169468 A 6/2013
CN 103931056 A 7/2014
CN 106663896 A 5/2017
CN 107666040 A 2/2018
CN 207638085 U 7/2018
DE 3686879 T2 4/1993
EP 2070474 A2 6/2009
EP 2476167-61 6/2014
EP 2548272-61 7/2015
EP 2779322-61 10/2015
EP 2745355-61 7/2017
EP 3473175 A1 4/2019
WO WO-2013/025335 A1 2/2013
WO WO-2016/033757 A1 3/2016
WO WO-2017/174153 A1 10/2017
WO WO-2018/021712 A1 2/2018

* cited by examiner

FLAT ANGULAR CONNECTOR WITH LATCH MECHANISM

CROSS-REFERENCE TO RELATED APPLICATIONS

This application claims priority to European Patent Application EP 18 189 737.2, filed on Aug. 20, 2018, the disclosure of which is incorporated in this application in its entirety.

FIELD OF THE INVENTION

The invention relates to a flat connector with a latch mechanism that comprises a latch handle portion, which can be moved from an engagement position to a release position. The invention further relates to a mating connector for engagement with the flat connector. Moreover, the invention relates to a set comprising the connector and the mating connector.

BACKGROUND OF THE INVENTION

EP 2745355 B1 discloses a connector with a tab which is slid into a corresponding aperture of a device and with a cover which can be moved inwardly or outwardly in order to engage the connector with the device or disengage it, respectively. The cover is provided with a slidable latch to secure it in the engaged position.

A similar connector is known from U.S. Pat. No. 9,300,086 B1 and U.S. Pat. No. D769,823 S. The connector is configured to connect a cable and the communication device by inserting a tab into a tab reception slot of the socket region of the communication device, and from an opposite end, pivotally buckling a spring-loaded head onto a flange of the socket region.

U.S. Pat. No. 6,454,608 B1 relates to a connecting adapter for connecting an earphone with a body part of a writs type of music player. On the outer surface of the adapter's casing, a fixed hook 507 for engaging with a concavity of the music player's body part is provided. Moreover, the adapter comprises a movable hook for engaging with another concavity of music player's body part. The movable hook is rotatable and it is biased toward the music player's body part.

EP 2779322 B1 A discloses a break-away connector assembly comprising a plug member and a socket portion configured for mating with the plug member. The plug member includes a first engagement claw having a first angled surface positioned to engage a first complementary angled surface of the socket portion. In addition, there is a lever arm pivotally mounted on the plug member and movable between a first position for coupling the plug member to the socket portion and a second position for uncoupling the plug member from the socket portion. The lever arm is spring-biased toward the first position and includes a second engagement claw having a second angled surface configured to engage a second complementary angled surface of the socket portion when the lever arm is in the first position. Similar connector assemblies are disclosed in EP 2476167 B1, EP 2548272 B1, U.S. Pat. No. 7,442,060 B2 and U.S. Pat. No. D615,040 S.

ITT Inc, 56 Technology Drive Irvine, Calif. 92618, USA offers for sale under the brand name Cannon Rock-in-Lock a latching connector set, the first part of which comprises on one end two tabs that can be inserted into corresponding slots of the second part. Moreover, another tab at the other end of the first part can engage with a spring-loaded pivotable latch of the second part.

Glenair, Inc, 1211 Air Way, Glendale, Calif. 91201, USA offers for sale under the brand name Mousebud a snap-lock connector set with a plug that comprises rotatable coupling nut. The coupling nut can engage the shell of the plug with the shell of a receptacle of the connector by means of bayonet pins. A torsion spring biases the nut in the engaged position.

OBJECT OF THE INVENTION

It is an object of the present invention to provide an improved flat connector with a latch mechanism comprising a latch handle portion which can be moved from an engagement position to a release position. It is another object of the invention to provide an improved mating connector for engagement with the flat angular connector. It is a further object of the invention to provide an improved set comprising a connector and a mating connector.

In some aspects, the invention aims to provide a flat connector that when worn on uniform parts, for example of emergency responders, medical personnel, soldiers or police, is less of an obstacle than conventional connectors. Also, in some aspects the invention aims to provide a flat connector that can conveniently be engaged and released with one hand and without having to visually inspect the connector. Moreover, in some aspects the present invention aims to provide a mating connector that is less prone to collect dirt and dust and is easier to clean than conventional mating connectors.

Solution According to the Invention

The reference numerals in the patent claims are not meant to be limiting but merely serve to improve readability of the claims.

In one aspect of the invention, the problem is solved by a flat connector with the features of claim 1. The flat connector has a latch mechanism comprising two latch handle portions provided at opposite sides of the connector. The latch handle portions can be moved from an engagement position to a release position. The connector is an angular cable connector, and for both handle portions the direction of the path from the engagement position to the release position is towards the cable end of the connector. The latch handle portions are elastically biased towards their engagement position.

In the context of the present invention, any reference to one (including the articles "a" and "the"), two or another number of objects is, provided nothing else is expressly mentioned, meant to be understood as not excluding the presence of further such objects in the invention. Thus, for example when a claim refers to the presence of "two latch handle portions", its scope of protection also encompasses embodiments which in addition comprise one or more further latch handle portions.

A "flat connector" is a connector the largest extension of which along the normal of the connector face is less than the largest extension of the angular cable connector along the cable orientation. The "connector face" is a surface on which electrical contact(s) and/or fluid port(s) is or are arranged for being electrically or fluidly connected to corresponding contacts or fluid ports of a mating connector. The normal of the connector face is a vector that is perpendicular to the connector face; if the connector face is curved, the normal of the connector face is a vector that extends in the average direction of the normal to the tangent planes of the connector face. The preferred connector face is a plane. A preferred flat connector has one or more electrical contact(s) and/or one or more fluid port(s). A preferred flat connector only comprises one or more electrical contacts but no fluid ports.

A "cable connector" is a connector that is intended to be attached to a cable or a fluid tube in a way that one or more leads of the cable are electrically connected to one or more electrical contacts of the cable connector and/or the tube or one or more tubes of the cable are or more fluid tubes of the cable are in flow connection with one or more fluid ports of the connector. A "fluid tube" is a tube, pipe or hose for transporting fluids. A "fluid port" is a fluid inlet or fluid outlet. A cable can contain one or more electrical leads and/or one or more fluid tubes. A preferred cable only comprises one or more electrical leads but no fluid tubes.

An "angular cable connector" is a cable connector in which the cable orientation is at an angle relatively to the normal of the connector face. The "cable orientation" is the intended longitudinal orientation of the cable or tube to which the connector is intended to be attached. The "cable end" of a cable connector is the end on which the cable or tube to which the connector is intended to be attached enters the connector.

The "engagement position" of a latch handle portion is a position of the latch handle portion which forces the latch mechanism into an engagement state. The "engagement state" of the latch mechanism is a state in which the latch mechanism can engage the connector with a mating connector. In an engaged state, the connector is fixed to the mating connector. Conversely, the release position of a latch handle portion is a position of the latch handle portion which forces the latch mechanism into a release state. The "release state" of the latch mechanism is a state in which the latch mechanism can release the connector from the mating connector. In a released state, the connector is not fixed to the mating connector but can be removed from the mating connector. A latch handle portion can be biased indirectly through the latch mechanism which the latch handle portion operates or directly.

In another aspect of the invention, the problem is solved by a flat connector with the features of claim 2. The flat connector has a latch mechanism comprising at least one latch handle portion, which latch handle portion can be moved from an engagement position to a release position. The path from the engagement position to the release position is linear. The handle portion is elastically biased towards its engagement position.

In a further aspect of the invention, the problem is solved by a flat connector with the features of claim 3. The flat connector has a latch mechanism comprising at least one latch handle portion which latch handle portion can be moved from an engagement position to a release position. The connector is an angular cable connector and the path from the engagement position to the release position is towards the cable end of the connector and extends in the plane of the handle portion. The handle portion is elastically biased towards its engagement position.

In the context of the present invention, "the path extends in the plane of the latch handle portion" means that a plane exists in which the latch handle portion extends such that no projection or depression in the handle portion extends in a direction perpendicular to the plane for more than a fifth, preferably a tenth, of the largest diameter of the latch handle portion, and that the path extends at an angle of less than 30° (with regard to a 360° full circle) relatively to the plane of the latch handle portion.

In some embodiments, the connector according to the invention can be used to connect electronic equipment, for example communications equipment, navigation equipment, night-vision devices and the like, to garments such as uniform parts, for example of emergency responders, medical personnel, soldiers or police, which uniform parts are provided with one or more mating connector(s) and wiring. It is an achievable advantage of the flat design of the connector that it is less of an obstacle when worn on the body. It is an achievable advantage of the elastic bias that an operator can conveniently engage and release with one hand and without having to visually inspect the connector.

In a yet further aspect of the invention, the problem is solved by a mating connector for engagement with the flat connector. The mating connector comprising a mating connector face with electrical mating contacts for contacting the electrical contacts of the connector. The contact faces of the mating contacts are flush with the mating connector face. It is an achievable advantage of the contact faces of the mating contacts being flush with the mating connector face that the connector face are less prone to collecting dirt and dust and can be cleaned more easily than in a case where the contact face would protrude from the mating connector face or would be located in recesses in the mating connector face.

In a yet further aspect of the invention, the problem is solved by a set comprising a connector according and a mating connector.

PREFERRED EMBODIMENTS OF THE INVENTION

Preferred features of the invention which may be applied alone or in combination are discussed in the following and in the dependent claims.

A preferred flat connector is a cable connector. It is an achievable advantage of this embodiment of the invention that electronic equipment attached to the connector via a cable can be placed on a uniform part and operated more conveniently. It is another achievable advantage of this embodiment of the invention that the connector can be held at the cable, facilitating the handling of the connector. Preferably, for one or more handle portions of the connector, a path from the engagement position to the release position is towards the cable end of the connector. It is an achievable advantage of this embodiment of the invention that it is particularly intuitive and therefore easy to implement for a user, i.e., because pulling a plug conventionally involves a motion towards the cable end of a plug.

Preferably, the flat connector is an angular connector. Advantageously, an angular connector can provide for a particularly flat design. The angular character of the connecter preferably is such that the cable orientation is at an angle of more than 60, preferably more than 70, more preferably more than 80 degrees relative to the connector face. The angular character of the connector preferably is such that in the cable orientation is at an angle of less than 120 degrees, preferably less than 110 degrees, more preferably less than 100 degrees relative to the connector face. In a particularly preferred embodiment the cable orientation is perpendicular to the connector face. Advantageously, with an angular connector can be even easier for an operator to grip and operate the latch handle portions. Moreover, advantageously, it is achievable with an angular connector that the cable extends essentially in the plane of the garment, thereby being less of an obstacle.

In a preferred embodiment of the invention, the path from the engagement position to the release position extends in the plane of the latch handle portion. With this embodiment of the invention it can be achieved that the operation of the handle portion is a side-ways sliding operation rather than a push or pull operation. This can contribute to avoiding that the handle portion(s) is/are accidentally operated to release the connector from the mating connector. Preferably, the path extends at an angle of less than 20°, more preferably less than 10°, more preferably less than 5° with the plane of the latch handle portion. Even more preferably the path extends in the plane of the latch handle portion.

Preferably, the path from the latch handle portion's engagement position to its release position is linear. Advantageously, a linear path allows for a linear operation of the latch handle portion, which in particular can be more intuitive in the context of the release of a connector than a rotational motion.

A preferred flat connector comprises two latch handle portions provided at opposite sides of the connector, which latch handle portions can be moved from an engagement position to a release position. With this feature it can be achieved that a user can easily grip the latch handle portions for example with the thumb and the index finger to move it from the engagement position to the release position. Preferably, the paths of the latch handle portions extend in parallel, which can further facilitate handling of the latch handle portions. Preferably, the connector is a cable connector and for both latch handle portions the path from the engagement position to the release position is linear. Preferably, for both latch handle portions the path from the engagement position to the release positon extends in the plane of the respective handle portion.

The two latch handle portions preferably are arranged on lateral sides of the connector. In the context of the present invention, the "lateral sides" are the sides of the connector that extend from an edge of the side of the connector where the connector face is located to the edge of the opposite side of the connector and from an edge of the cable end side of the connector to an edge of the opposite end side of the connector. The lateral sides are particularly easy to grip and hold to, facilitating the operation of the latch handle portions and the removal of the released connector from the mating connector. Preferably, the lateral sides extend perpendicularly to the connector face of the flat angular connector. The lateral sides preferably extend in the cable orientation of the connector.

Biasing of the latch handle portion(s) towards the engagement position preferably is achieved by means of one of more springs. In a particularly preferred embodiment of the invention each latch handle portion is provided with its own elastic element(s), for example one or more springs. This feature can provide for a smoother and thus more convenient operation of the latch handle portions and can simplify construction of the flat angular connector. A preferred spring is a helical spring.

In a preferred embodiment of the invention on the side of the connector where the connector face is located the latch mechanism comprises a latch surface that when the latch handle is in the engagement position can engage a corresponding mating latch surface for engaging the mating connector. Alternatively, one or both of the latch surface and the mating latch surface can be only an edge or even only a point. The preferred latch surface, edge or point is located on a latch hook of the latch mechanism.

The preferred latch mechanism can be moved from an engagement state, in which the latch surface, edge or point can engage a corresponding mating latch surface, edge or point for engaging the connector with the mating connector, to a release state where the latch surface, edge or point no longer engages the corresponding mating latch surface, edge or point. Preferably, when the latch handle portion(s) is or are moved from the engagement position to the release position, the latch surface, edge or point is moved into a direction where it can no longer engage the mating latch surface, edge or point of the mating connector.

Preferably, the direction of the path of the latch handle portion(s) from the engagement position to the release position has the same direction as the path of the latch surface, edge or point from the engagement state to the release state. More preferably, the path(s) of the latch handle portion(s) and the latch surface, edge or point extend in parallel. Preferably, when viewed along the cable orientation the latch surface, edge or point is located between the connector face and the connector's cable end side.

In a preferred flat angular connector according to the invention, the part of the latch mechanism with the latch surface, edge or point and the latch handle portion(s) are formed in one piece, for example by means of injection moulding and/or machine tooling.

The preferred latch mechanism is provided with a running surface that can cooperate with a portion of the mating connector to move at least part of the latch mechanism against the bias from the engagement state towards the release state so that the mating latch surface can reach a position where it can cooperate with the connector's latch surface, in order to engage the connector with the mating connector. Thereby it is achievable that the connector can be brought into engagement with the mating connector without operation of the latch handle portion(s). This facilitates handling of the connector in particular in situations where a user cannot visually inspect the connector. Alternatively or in addition, a portion of the preferred mating connector is provided with a running surface that can cooperate with a portion of latch mechanism, preferably the portion of the latch mechanism with likewise has a running surface, to move at least part of the latch mechanism against the bias from the engagement state towards the release state so that the mating latch surface can reach a position where it can cooperate with the connector's latch surface, in order to engage the connector with the mating connector.

Preferably, the connector and the mating connector according to the present invention are operated in a way in which first the connector is provisionally borne pivotably by the mating connector, preferably near on one end of the connector, and then pivoted into a position where the connector also engages by means of the latch mechanism with the mating connector in order to fixedly engage the connector with the mating connector. The two-step mechanism can also be referred to as a "catch and lock" operation. Preferably, due to the running surface(s) the lock part of the operation can be accomplished without the need to directly manipulate the latch handle portion(s) of the connector.

On the side of the connector where the connector face is located, the connector preferably comprises a projection or a recess which can cooperate with a mating recess or mating projection of the mating connector to pivotably bear the connector on the mating connector. More preferably, the projection or recess of the connector is located on the far end of the connector face when viewed from the cable end side of the connector along the cable orientation. Preferably, the projection or recess of the connector on one hand and the latch surface of the latch mechanism on the other hand are located on opposite sides of the connector face when viewed along the cable orientation. Preferably, the pair of the projection or recess and the mating recess or mating projection of the connector and the mating connector on one side of the connector face and the pair of the latch surfaces of the connector and the mating connector on the other side of the connector face cooperate to fix the connector to the mating connector. Preferably the projection or the recess on the connector is linear. Preferably the mating recess or mating projection of the mating connector is linear.

A preferred flat angular connector has a circular connector face. This embodiment of the invention can allow for the convenient use of a regular o-ring surrounding the connector face as a seal.

In a preferred embodiment of the invention, the connector face or other parts, for example a collar, of the side of the connector where the connector face is placed are provided with one or more projections or recesses that correspond with mating recesses or projections on the mating connector to act as keys so that only connector's and mating connector's corresponding keys can be engaged with each other. Thereby advantageously it can be achieved that a connector can only be engaged with a mating connector it is intended to match with. In particular, multiple pairs of connectors and mating connectors can be provided which are not interoperable and therefore cannot be confused with each other. Alternatively or in addition, the keys can prevent engagement of the connector with the mating connector in any orientation other than the correct orientation.

In a preferred flat connector according to the present invention at the end of the connector opposite to the cable end the extension of the connector in the direction normal to the connector face decreases towards the end of the connector opposite to the cable end. With this embodiment of the invention it can be achieved that the connector is less of a hindrance in particular when it is applied to a garment such as a uniform part. Preferably, a housing of the connector on the side opposite the side of the connector face is sloped downwardly in a straight or curved fashion towards the end of the connector opposite the cable end. The preferred connector body comprises of two parts, a main body and a lid, the lid comprising the sloped part.

In a preferred embodiment of the connector, the connector face is provided with one or more spring loaded contact(s), which contact(s) preferably protrude from the connector face. Preferably, if a force is applied, the contact(s) yield to the force in a direction towards the inside of the connector. The inside ends of the preferred contacts are in electrical contact with contact pads of a printed circuit board (PCB). Advantageously, via the PCB, the contacts can be electrically contacted with leads of the cable, which leads preferably are soldered to the PCB.

A preferred connector face of the connector is provided with a seal around the connector face. Thereby, preferably, the connector face when connected can be protected from dirt, dust and liquids. The preferred seal is an o-ring.

A preferred mating connector for engagement with the flat connector comprises a mating connector face with electrical mating contacts for contacting the electrical contacts of the connector. Preferably, the contact faces of the mating contacts are flush with the mating connector face. The preferred of the mating connector are not spring loaded, i.e. they cannot yield to a force applied to them but, preferably, always remain flush with the connector face of the mating connector. Preferably, in the mating connector the contacts are in contact with contact pads of a PCB. Advantageously, via the PCB, the contacts can be electrically contacted with leads of the cable, which leads preferably are soldered to the PCB.

In a preferred mating connector, mating projection or recess of the mating connector is formed by a circular projection or recess around the connector face of the mating connector. Likewise, preferably, the latch surface of the mating connector is formed by a circular protrusion or recess, preferably the same circular protrusion or recess as that of the mating protrusion or recess, around the connector face of the mating connector. The preferred ring extends in a plane parallel to the mating connectors connector face. Thereby it is achievable, that the connector can engage the mating connector in any relative orientation with respect to an axis perpendicular to the plane in which the ring extends.

Preferably, the contact faces are ring-shaped, preferably the contact faces are coaxial rings. It is an achievable advantage of this embodiment of the invention that the contacts of the connector can electrically contact the corresponding contact faces of the mating connector irrespectively of the relative orientation of the connector and the mating connector.

The body of the preferred connector and/or of a preferred mating connector is from aluminium or zinc, preferably die cast aluminium or zinc, plastic, preferably injection moulded plastic, machined aluminium or steel, or sintered metal. Preferably, the part of the latch mechanism with the latch surface, edge or point and the latch handle portion(s) is from aluminium or zinc, preferably die cast aluminium or zinc, plastic, preferably injection moulded plastic, machined aluminium or steel, or sintered metal.

BRIEF DESCRIPTION OF THE DRAWINGS

In the following, further preferred embodiments of invention are illustrated by means of examples. The invention is not limited to these examples, however.

The drawings schematically show.

DETAILED DESCRIPTION OF AN EMBODIMENT OF THE INVENTION

Figure 1B:
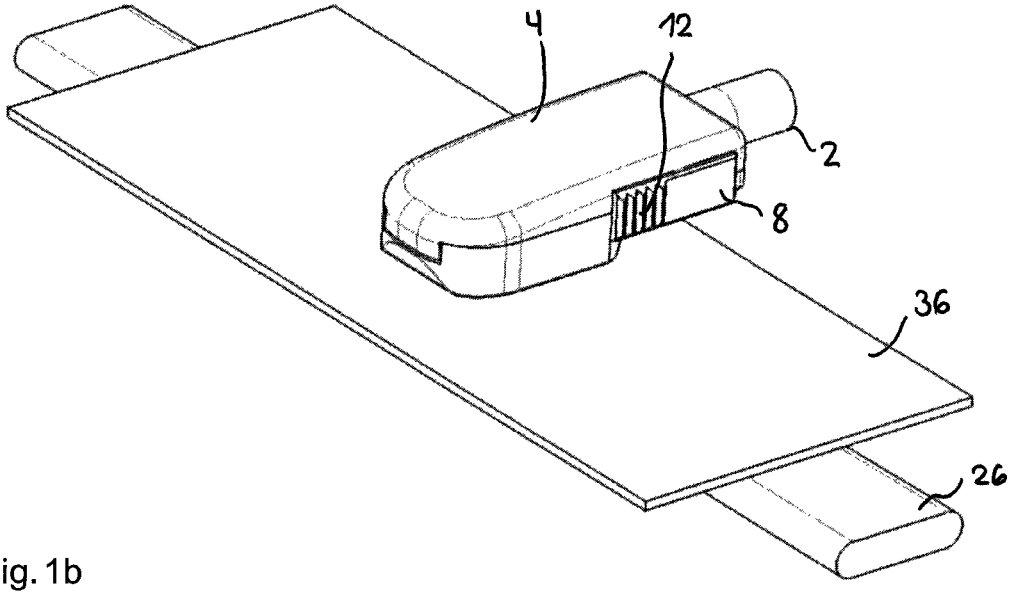
FIG. 1*b* A perspective view of the connector and the mating connector of FIG. 1*a* in engagement with each other.

In the following description of preferred embodiments of the invention, identical reference numerals refer to identical or similar components.

FIGS. 1*a* to 4 show a first embodiment of a flat connector 1 according to the invention. As can be seen best in FIGS. 1*a* and 1*b*, the connector has a flat body and is an angular cable connector with a cable 2 entering the connector at the cable end side. On the bottom of the body, the connector face 3 is exposed. The normal on the connector face is at a 90° angle relative to the direction of the cable orientation. As can be seen best in FIGS. 1*b* to 4, the top of the body has a downward slope 4 towards the end of the connector 1 opposite the cable 2 end so that at the end of the connector opposite to the cable 2 end the extension of the connector in the direction normal to the connector face 3 decreases towards the end of the connector 1 opposite to the cable 2 end. Preferably, the slope is in a lid part of the body of the connector, which can fixed to a main part of the body of the connector for example with screws, glue or latch and counter-latch elements.

The connector 1 moreover comprises a latch mechanism 5. In the first embodiment of the connector as shown in FIGS. 1*a* to 4, the latch mechanism 5 comprises a latch handle and a latch hook 6 with a latch surface 7, the latch handle and the latch hook 6 formed in one piece. The latch handle is slidably mounted on a body of the connector so that it can be moved back and forth in a direction of the cable 2 orientation. The latch handle comprises two latch handle portions 8 on opposite lateral sides of the connector 1. Each handle portion 8 is provided with a spring 9 that biases the handle portion 8 towards the end of the connector opposite to the cable 2 end. For this purpose, at the side of each latch handle portion 8 located on the inside of the connector 1, the spring 9 is placed between a spring seat 10 on the inside face of the latch handle portion 8 and a spring seat 11 on the connector body. On its outside, each latch handle portion 8 is provided with a hill-end-valley profile 12 in order to facilitate gripping the latch handle portions 8.

The connector face 3 of the connector 1 is provided with spring loaded contacts 13 that protrude from the connector face 3 and, if a force is applied, yield to the force in a direction towards the inside of the connector 1. The inside ends of the contacts 13 are in electrical contact with contact pads (not shown) of a PCB 14. Conducting paths (not shown) of the PCB 14 lead from the contact pads to solder pads 15 at one edge of the PCB 14. There, leads 16 of the cable 2 are soldered to the solder pads 15 in order to provide an electrical connection from the leads 16 to the corresponding contacts 13 of the connector face 3 of the connector 1. In order to protect the connector face 3 when connected against dirt, dust and liquids, an o-ring 17 is provided as a seal around the connector face 3.

Figure 5:
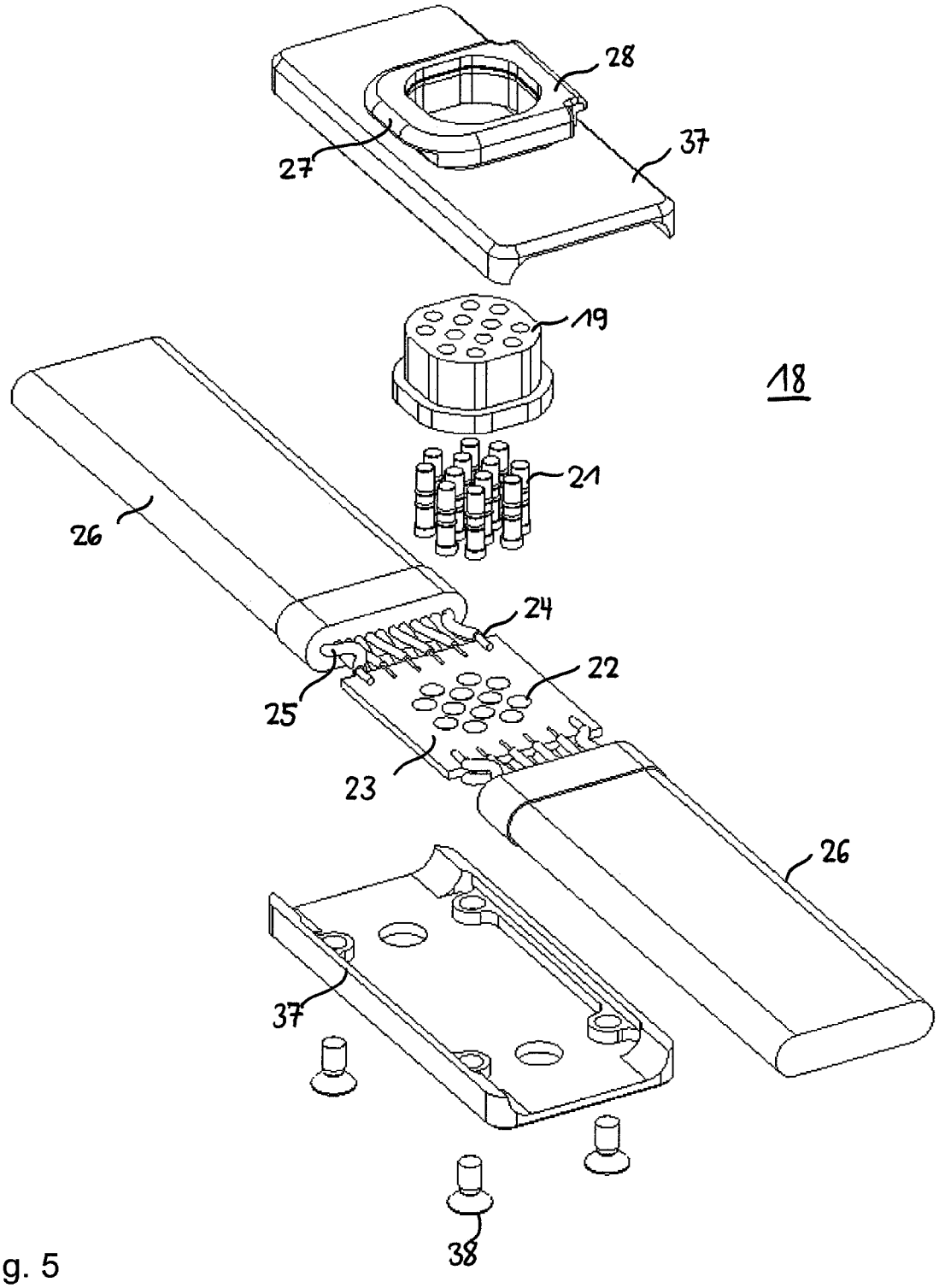
FIG. 5 An exploded view of the mating connectors of FIGS. 1*a* to 3.

The mating connector 18 is attached to a cloth 36, for example of a uniform piece. Like the connector 1, the mating connector 18 is provided with a connector face 19. Yet, unlike in the connector 1, the contact faces 20 of the contacts 21 of the connector face 19 of the mating connector 18 are flush with the connector face 19. In other words, they do not protrude from or are provided in recesses of the mating connector face 19. Also, the contacts 21 are not spring loaded, i.e. they cannot yield to a force applied to them. As can be seen in FIG. 5, similar to the internal design of the connector 1, in the mating connector 18 the contacts 21 are in contact with contact pads 22 of a PCB 23 which in turn are connected to solder pads 24 on two edges of the PCB 23. Leads 25 of two flat cables 26 are soldered to the solder pads 24 of the PCB 23. The mating connector has two body parts 37, which are joined by screws 38.

The mating connector 18 is provided with two projections 27, 28 on opposite sides of the connector face 19 to cooperate with corresponding projections 29, 7 on the connector 1 for engaging the connector 1 with the mating connector 18. This can best be seen in FIGS. 2*a*, 2*b* and 3 for the first embodiment of the connector 1 and 6*a* and 6*b* for the second embodiment of the connector 1.

Figure 3:
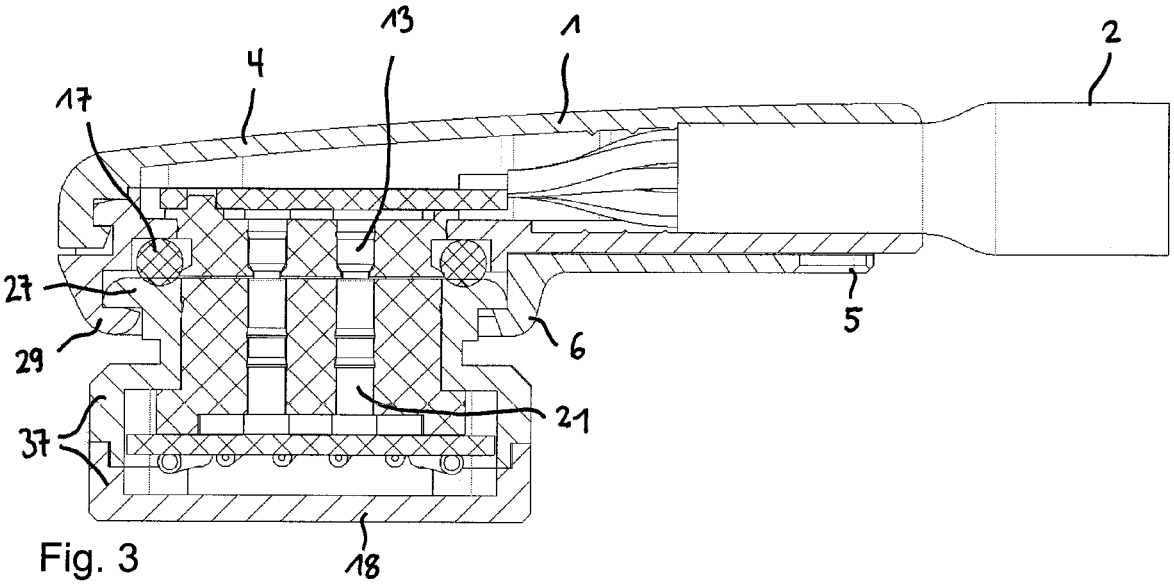
FIG. 3 A cross-sectional view of the connector and the mating connector of FIGS. 2*a* and 2*b*, the connector being engaged with the counter connector.
Figure 4:
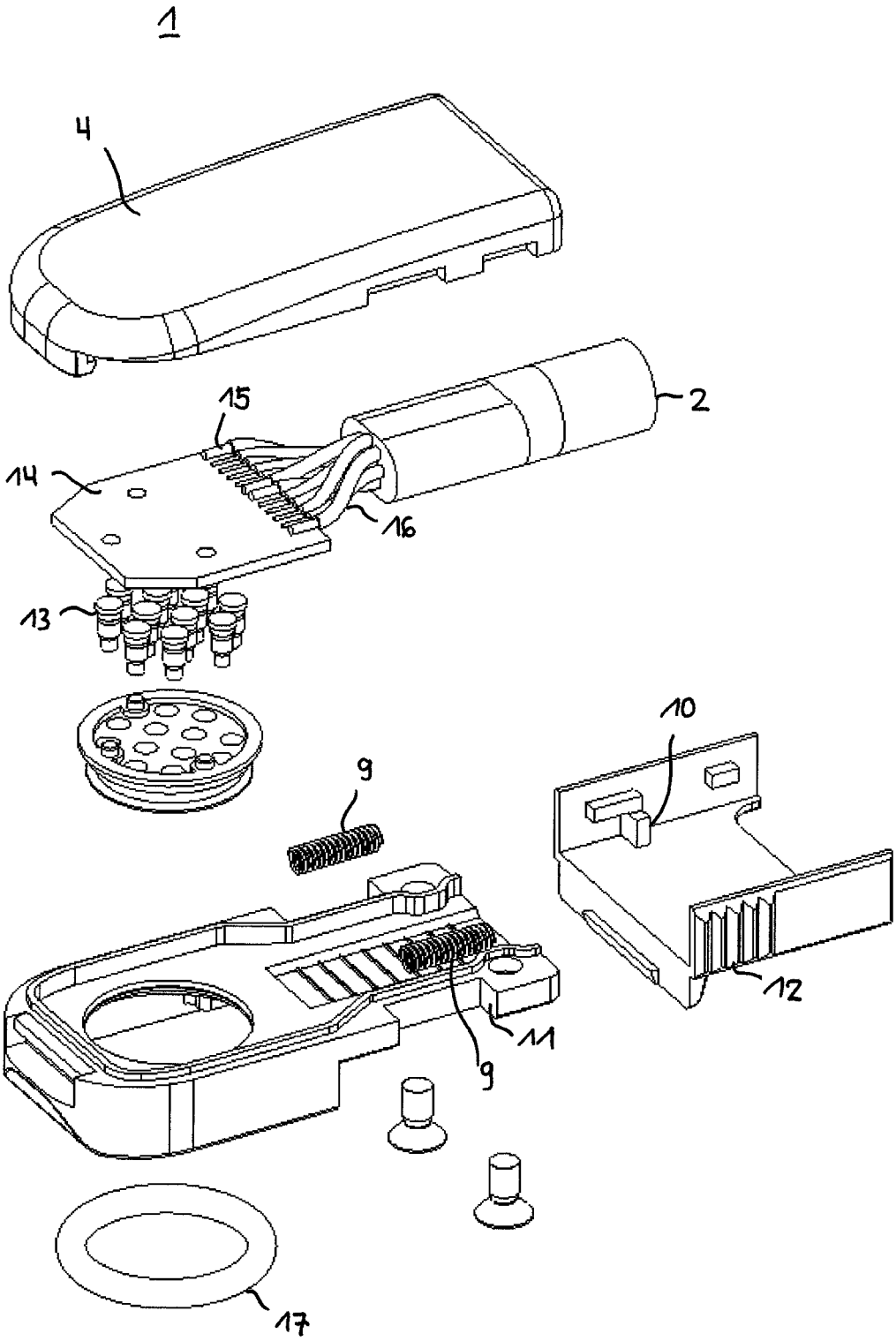
FIG. 4 An exploded view of the connector of FIGS. 1*a* to 3.
Figure 6A:
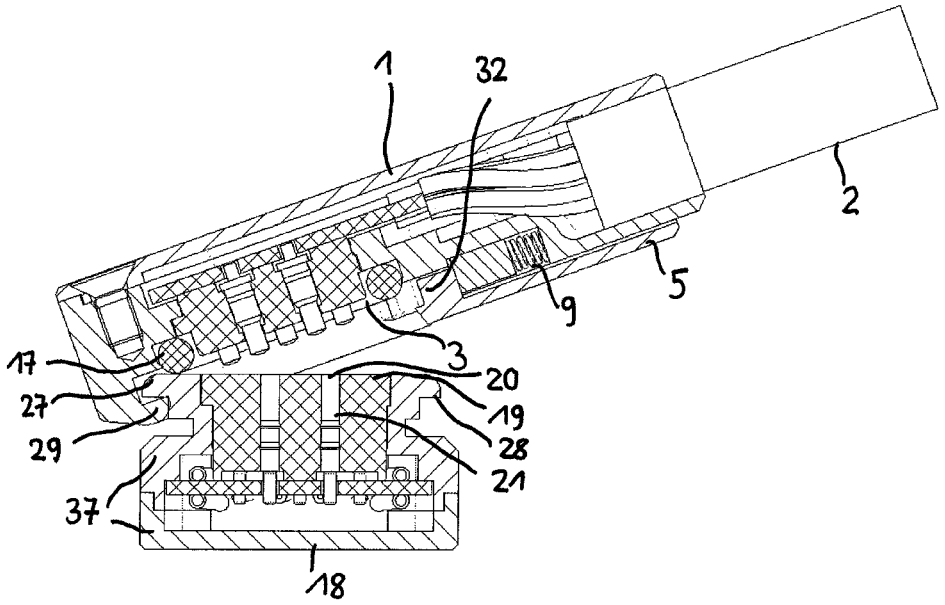
FIG. 6*a* A cross-sectional view of a second embodiment of a connector according to the invention and a mating connector, the connector being placed in a pivotable fashion on the mating connector.
Figure 6B:
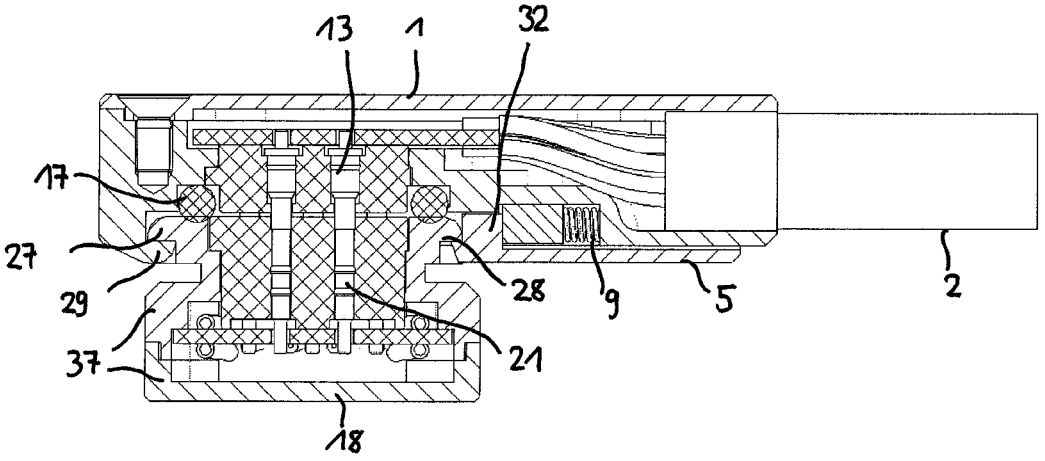
FIG. 6*b* A cross-sectional view of the connector of FIG. 6*a* in engagement with a mating connector.
Figure 6C:
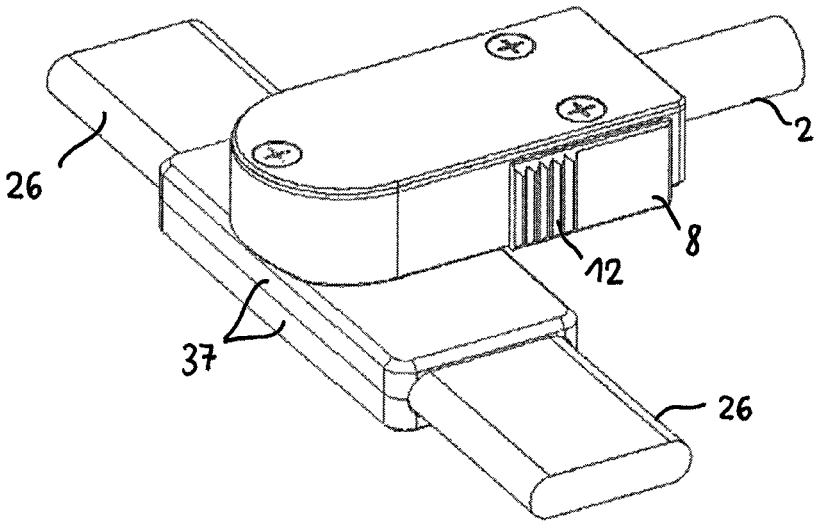
FIG. 6*c* A perspective view of the connector of FIGS. 6*a* and 6*b* in engagement with a mating connector.

In a first step of joining the connector 1 with the mating connector 18, a pivoting projection 29 of the connector grips under a corresponding pivoting projection 27 of the mating connector 18. The pivoting projections 29, 27 are located on the end of the connecter 1 opposite the cable 2 end. This can also be referred to as the "catch" step of the procedure of joining the connector 1 with the mating connector 18 as indicated by the arrow 30 in FIG. 2*a*. In a next step the cable 2 end of the connector 1 is pivoted relatively to the mating connector 18 about the pivot projections 29, 27 as is indicated with the arrow 31 in FIG. 2*b*. On the other side of the connector faces 3, 19, there is a latch projection 6 of the latch mechanism 5 of the connector and a corresponding latch projection 28 of the mating connector 18. Both projections 6, 28 are provided with running surfaces that, when they are moved towards each other while in contact, force the latch projection 6 and with it the latch mechanism 5 including the latch handle and the latch handle portions 8 towards the cable 2 end of the connector 1. As a result, the latch projection 6 of the connection gives way for a latch surface of the latch projection 28 of the mating connector to grip the latch surface 7 of the connector 1. This allows the latch mechanism 5 to return into its engagement position and as a result secure the connector 1 engaged with the mating connector 18 as can be seen in FIGS. 3 and 6*b*.

FIGS. 6*a*, 6*b*, 6*c*, 7*a* and 7*b* show a second embodiment of the connector 1 in which the springs 9, rather than biasing the latch handle, directly bias a latch bar 32 which is in mechanical contact with and biased against the latch handle and thereby indirectly biases the latch handle towards the end of the connector 1 opposite the cable 2 end. Again, latch handle and latch projection 6 with the latch surface 7 are made in one piece. Also in the second embodiment, on the end of the connector opposite the cable 2 end the body on the side opposite the side of the connector face 3 is not downwardly sloped but flat. The entire connector 1 has an essentially uniform height in the direction perpendicular to the connector face 3.

Figure 1A:
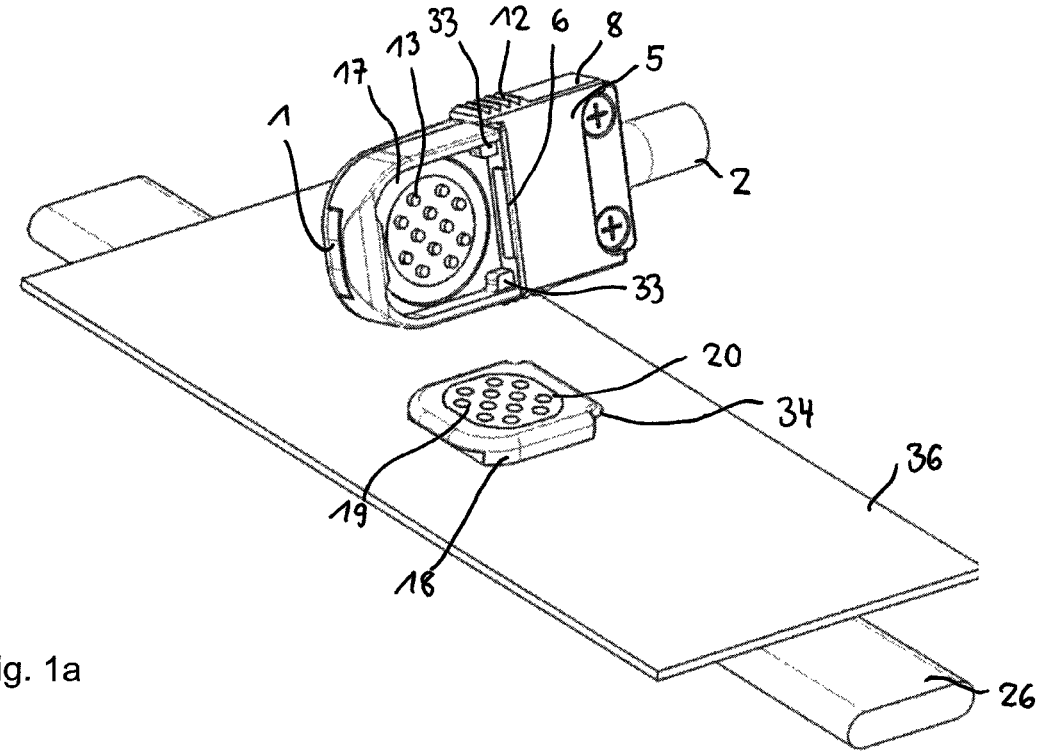
FIG. 1*a* A perspective view of an embodiment of a connector of the invention and a mating connector of the invention separated from each other.
Figure 2A:
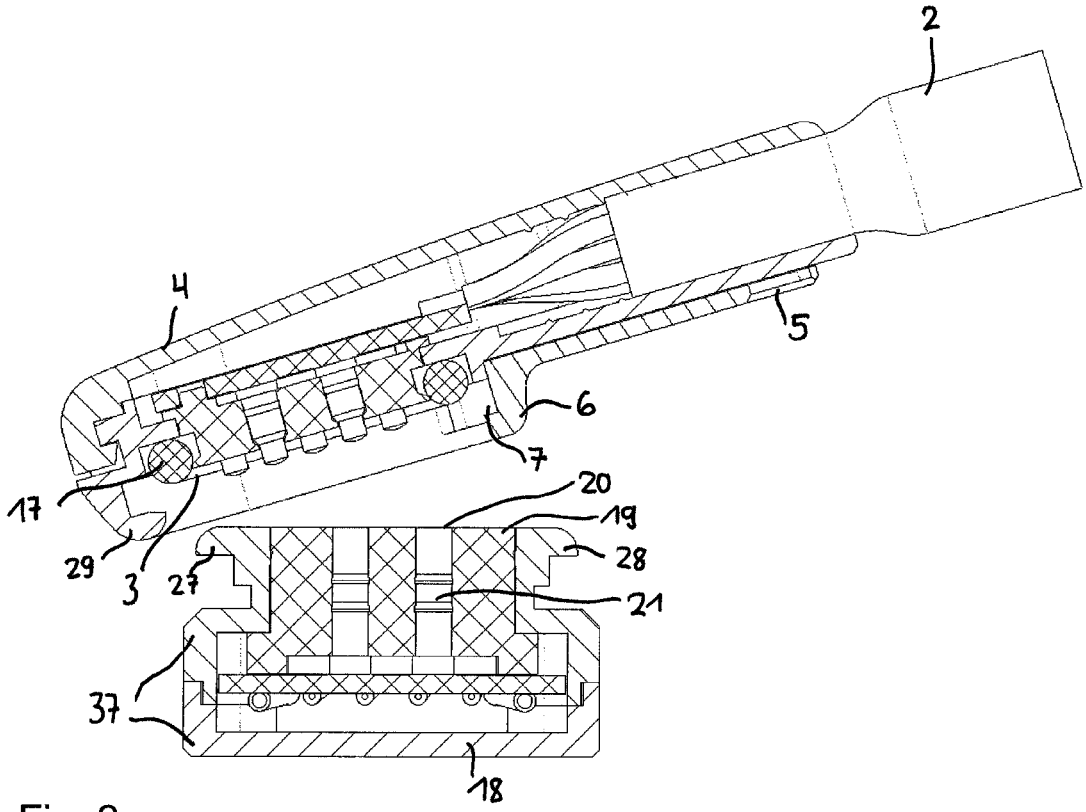
FIG. 2*a* A cross-sectional view of the connector and the mating connector of FIGS. 1*a* and 1*b* separated from each other.
Figure 2B:
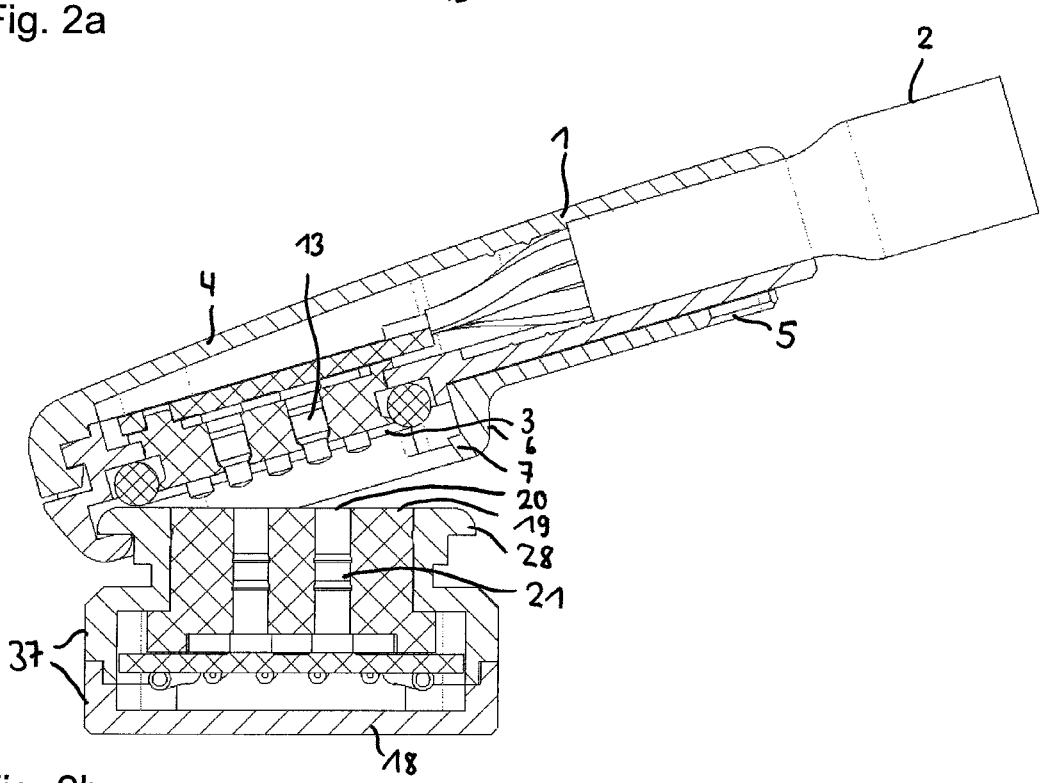
FIG. 2*b* A cross-sectional view of the connector and the mating connector of FIG. 2*a*, the mating connector being placed in a pivotable fashion on the mating connector.
Figure 7A:
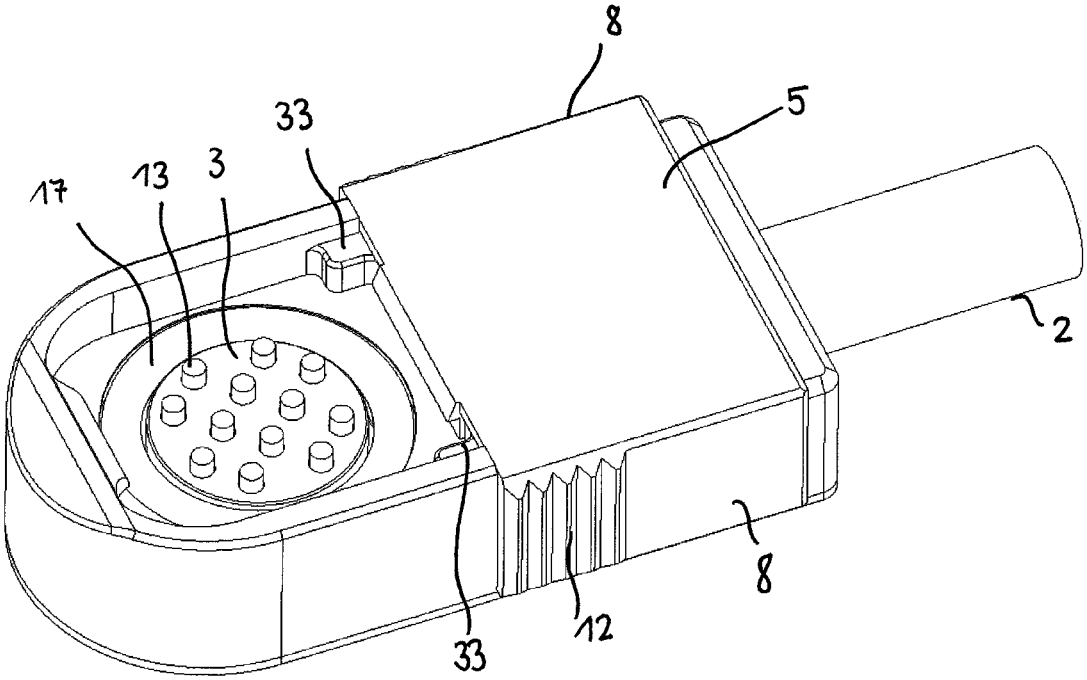
FIG. 7*a* A perspective view of the connector of FIGS. 6*a* and 6*b*, showing the connector face.
Figure 7B:
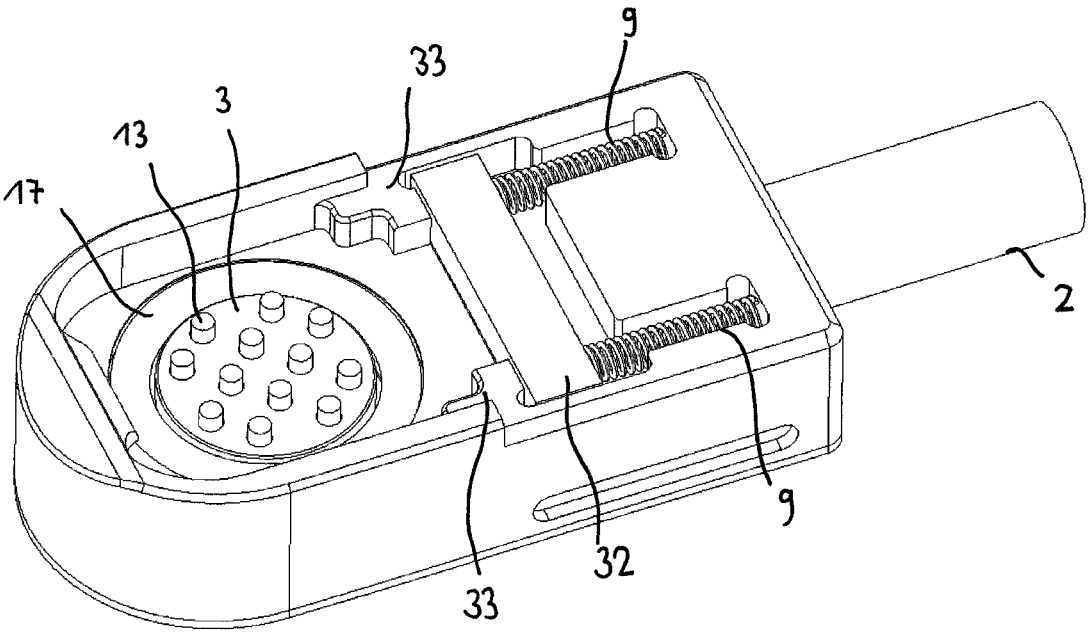
FIG. 7*b* A perspective view of the connector of FIG. 7*a* with the latch handle removed.
Figure 8:
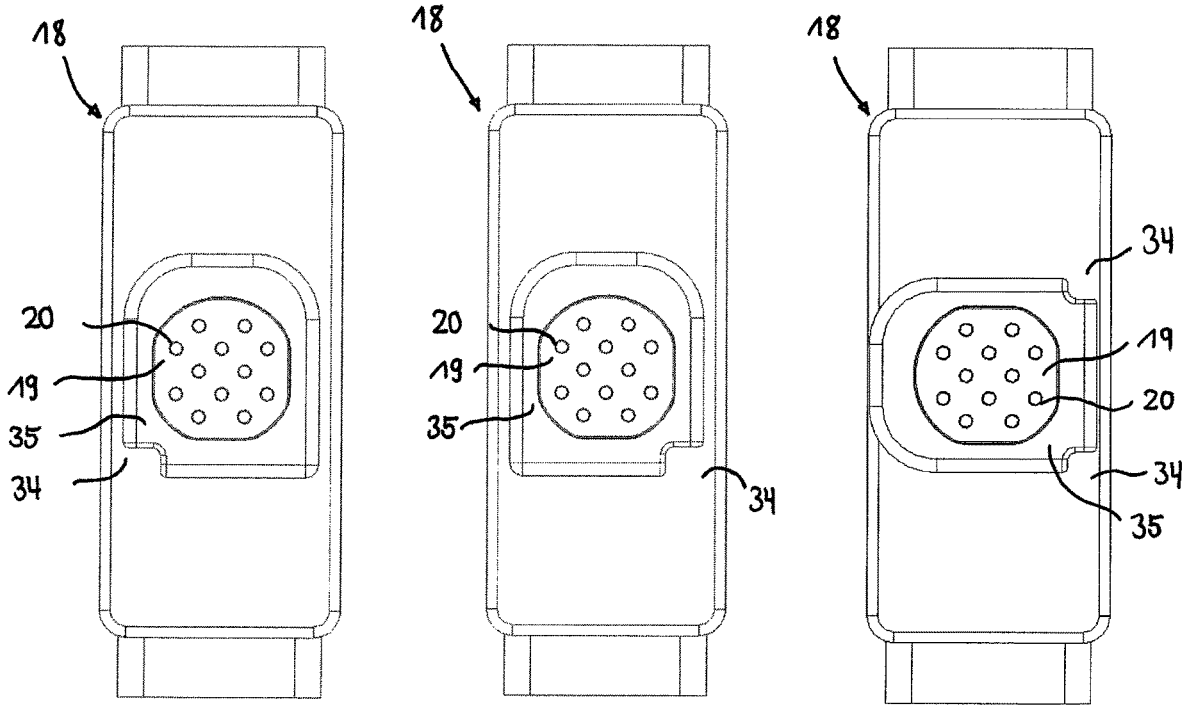
FIG. 8 A top view on the mating connector of FIG. 5 with different key recesses.

FIGS. 1*a*, 7*a* and 7*b* also show projections 33 on the side of the connector with the connector face, the projections being placed near the connector face 3 but outside the seal 17. These projections 33 can operate with recesses 34 in a collar 35 provided around the mating connector's 18 connector face 19. The projections 33 and recesses 34 serve as keys so that only connectors 1 and mating connectors 18 with corresponding keys can be brought into engagement with each other. In addition or alternatively, such keys can prevent engagement of the connector 1 with the mating connector 18 in any orientation other than the correct orientation.

Figure 9A:
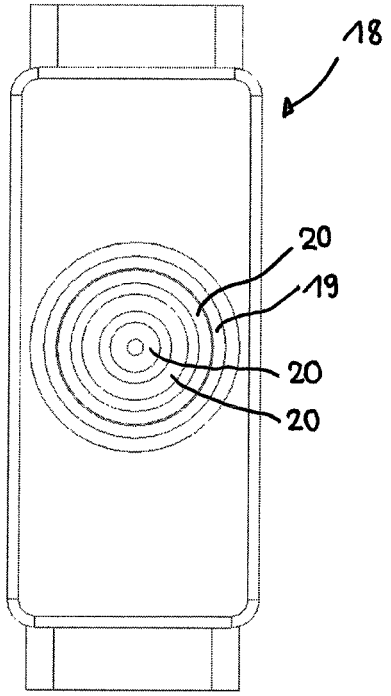
FIG. 9*a* A top view on an alternative embodiment of a mating connector.
Figure 9B:
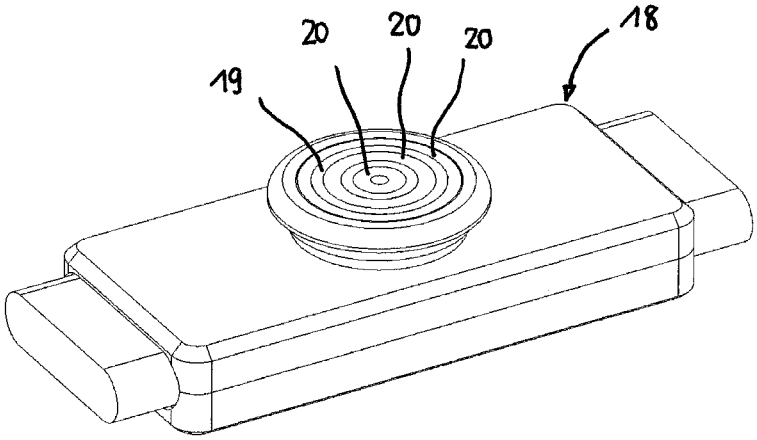
FIG. 9*b* A perspective view on the mating connector of FIG. 9*a*.

FIGS. 9*a* and 9*b* show an alternative embodiment of the mating connector 18, in which the mating projection 27 and the latch projection 28 of the mating connector 18 are formed by a circular protrusion around the connector face 19 of the mating connector 18. As a result, the connector 1 can engage the mating connector 18 in any relative orientation. In addition, the contact faces 20 of the connector face 19 of the mating connector 18 form coaxial rings, so that the contacts 13 of the connector 1 can electrically contact the corresponding contact faces 20 of the mating connector 18 irrespectively of the relative orientation of the connector 1 and the mating connector 18. In this embodiment, there are no keys for ensuring that the connector and mating connector cannot engage in any orientation other than the correct orientation.

The features as described in the above description, claims and figures can be relevant individually or in any combination to realise the various embodiments of the invention.

The invention claimed is:

1. A set comprising a flat connector and a mating connector, the flat connector comprising a latch mechanism, the latch mechanism comprising two latch handle portions provided at opposite sides of the flat connector, which latch handle portions can be moved from an engagement position to a release position, wherein the flat connector is an angular cable connector in which the cable orientation is at an angle relatively to the normal of a flat connector face, and the directions of the paths from the engagement position to the release position of the handle portions extend in parallel towards the cable end of the connector, and wherein the latch handle portions are elastically biased towards their engagement position, wherein on the side of the flat connector where the flat connector face is located, the flat connector comprises a projection or a recess that can cooperate with a mating recess or mating projection of the mating connector to pivotably bear the flat connector on the mating connector, wherein the flat connector is configured for being provisionally borne pivotably by the mating connector and for being pivoted into a position where the flat connector also engages by means of the latch mechanism with the mating connector.

2. The set of claim 1, wherein the two latch handle portions are arranged on lateral sides of the flat connector.

3. The set of claim 1, wherein the cable orientation is at an angle of between 60 and 120 degrees relatively to the normal of the flat connector face.

4. The set of claim 1, wherein the latch handle portion(s) is/are biased towards the engagement position with one or more springs.

5. The set of claim 1, wherein on the side of the flat connector where the flat connector face is located the latch mechanism comprises a latch surface that when the latch handle is in the engagement position can engage a corresponding mating latch surface for engaging the connector with the mating connector.

6. The set of claim 5, wherein the latch handle portions and the part of the latch mechanism with the latch surface are formed in one piece.

7. The set of claim 1, wherein the latch mechanism is provided with a running surface that can cooperate with a portion of the mating connector to move at least part of the latch mechanism against the bias from the engagement state towards the release state so that the mating latch surface can reach a position where it can cooperate with the connector's latch surface.

8. The set of claim 1, further comprising a connector face, wherein on the side of the flat connector where the flat connector face is located the flat connector comprises a projection or a recess that can cooperate with a mating recess or mating projection of a mating connector to pivotably bear the connector on the mating connector.

9. The set of claim 1, further comprising a circular connector face.

10. The set of claim 1, further comprising a connector face wherein, at the end of the connector opposite to the cable end, the extension of the connector in the direction normal to the connector face decreases towards the end of the connector opposite to the cable end.

11. A set comprising a flat connector and a mating connector, the flat connector comprising a latch mechanism, the latch mechanism comprising a latch handle portion, which latch handle portion can be moved from an engagement position to a release position, wherein the flat connector is an angular cable connector in which the cable orientation is at an angle relatively to the normal of a flat connector face, and wherein the latch handle portion's path from the engagement position to the release position is linear and in the direction of the cable orientation, and wherein the handle portion is elastically biased towards its engagement position, wherein on the side of the flat connector where the flat connector face is located, the flat connector comprises a projection or a recess that can cooperate with a mating recess or mating projection of the mating connector to pivotably bear the flat connector on the mating connector, wherein the flat connector is configured for being provisionally borne pivotably by the mating connector and for being pivoted into a position where the flat connector also engages by means of the latch mechanism with the mating connector.

12. The set of claim 11, wherein the flat connector comprises two latch handle portions provided at opposite sides of the connector, which latch handle portions can be moved from an engagement position to a release position.

13. The set of claim 11, wherein the latch handle portion (s) is/are biased towards the engagement position with one or more springs.

14. The set of claim 11, wherein on the side of the flat connector where the flat connector face is located the latch mechanism comprises a latch surface that when the latch handle is in the engagement position can engage a corresponding mating latch surface for engaging the connector with the mating connector.

15. The set of claim 11, wherein the latch mechanism is provided with a running surface that can cooperate with a portion of the mating connector to move at least part of the latch mechanism against the bias from the engagement state towards the release state so that the mating latch surface can reach a position where it can cooperate with the connector's latch surface.

16. The set of claim 11, further comprising a connector face, wherein on the side of the flat connector where the connector face is located the flat connector comprises a projection or a recess that can cooperate with a mating recess or mating projection of a mating connector to pivotably bear the connector on the mating connector.

17. The set of claim 11, further comprising a circular connector face.

18. The set of claim 11, further comprising a connector face wherein, at the end of the connector opposite to the cable end, the extension of the connector in the direction normal to the connector face decreases towards the end of the connector opposite to the cable end.

19. A set comprising a flat connector and a mating connector, the flat connector comprising a latch mechanism, the latch mechanism comprising a latch handle portion which latch handle portion can be moved from an engagement position to a release position, wherein the flat connector is an angular cable connector in which the cable orientation is at an angle relative to the normal of the connector face, and the path from the engagement position to the release position is towards the cable end of the flat connector and extends in the plane of the handle portion, and wherein the handle portion is elastically biased towards its engagement position, wherein on the side of the flat connector where a flat connector face is located, the flat connector comprises a projection or a recess that can cooperate with a mating recess or mating projection of the mating connector to pivotably bear the flat connector on the mating connector, wherein the flat connector is configured for being provisionally borne pivotably by the mating connector and for being pivoted into a position where the flat connector also engages by means of the latch mechanism with the mating connector.

20. The set of claim 19, wherein the flat connector comprises two latch handle portions provided at opposite sides of the connector, which latch handle portions can be moved from an engagement position to a release position.

21. The set of claim 19, wherein the cable orientation is at an angle of between 60 and 120 degrees relatively to the normal of the flat connector face.

22. A method for operating a flat connector and a mating connector, the flat connector comprising a latch mechanism, the latch mechanism comprising a latch handle portion, which latch handle portion can be moved from an engagement position to a release position, wherein the flat connector is an angular cable connector in which the cable orientation is at an angle relatively to the normal of the connector face and the path from the engagement position to the release position is towards a cable end of the flat connector and extends in the plane of the handle portion, wherein the handle portion is elastically biased towards its engagement position, comprising the steps of provisionally bearing the flat connector pivotably by the mating connector; and pivoting the flat connector into a position where the flat connector also engages by means of the latch mechanism with the mating connector in order to fixedly engage the flat connector with the mating connector.

* * * * *